US010519609B2

(12) United States Patent
Nguyen et al.

(10) Patent No.: US 10,519,609 B2
(45) Date of Patent: Dec. 31, 2019

(54) RAIL CLIP

(71) Applicant: PROGRESS RAIL SERVICES CORPORATION, Albertville, AL (US)

(72) Inventors: Thai Nguyen, De Soto, KS (US); Jose Ricardo Mediavilla, Kansas City, MO (US); Michael Steidl, Wackersdorf (DE)

(73) Assignee: Progress Rail Services Corporation, Albertville, AL (US)

( * ) Notice: Subject to any disclaimer, the term of this patent is extended or adjusted under 35 U.S.C. 154(b) by 161 days.

(21) Appl. No.: 15/560,249

(22) PCT Filed: Apr. 6, 2016

(86) PCT No.: PCT/US2016/026183

§ 371 (c)(1),
(2) Date: Sep. 21, 2017

(87) PCT Pub. No.: WO2016/164440

PCT Pub. Date: Oct. 13, 2016

(65) Prior Publication Data

US 2018/0051422 A1 Feb. 22, 2018

(30) Foreign Application Priority Data

Apr. 7, 2015 (AU) ..... 2015901236

(51) Int. Cl.

| | |
|---|---|
| ***E01B 9/48*** | (2006.01) |
| ***E01B 9/30*** | (2006.01) |
| ***E01B 5/00*** | (2006.01) |

(52) U.S. Cl.

CPC ..... *E01B 9/486* (2013.01); *E01B 5/00* (2013.01); *E01B 9/306* (2013.01); *E01B 2205/00* (2013.01)

(58) Field of Classification Search

CPC . E01B 9/48; E01B 9/483; E01B 9/486; E01B 9/30; E01B 9/303; E01B 9/306; E01B 9/34

See application file for complete search history.

(56) References Cited

U.S. PATENT DOCUMENTS 1,839,725 A * 1/1932 Armstrong ..... E01B 9/30 238/304
1,863,197 A * 6/1932 Faries ..... E01B 9/486 238/304

(Continued)

FOREIGN PATENT DOCUMENTS

| | | |
|---|---|---|
| GB | 148222 | 9/1921 |
| GB | 829623 | 3/1960 |
| GB | 873694 | 7/1961 |

OTHER PUBLICATIONS

Corresponding International Search Report and Written Opinion for PCT/US2016/026183 dated May 16, 2016. WO.

*Primary Examiner* — Jason C Smith

(57) ABSTRACT

A flat bar elastic rail clip in which the flat bar is turned back on itself so that one portion is longer than the other. The flat bar incorporates an opening in both portions to accommodate a rail spike that is held in the rail tie. This type of spike is usually used in combination with a concrete tie and a guide plate that seats on the rail seat of the tie. The combination of a shaped flat bar clip which is capable of providing both rail clamping and rollover protection configurations in combination with a guide plate and spike.

11 Claims, 5 Drawing Sheets

(56) References Cited

U.S. PATENT DOCUMENTS 4,179,067 A * 12/1979 Baier ..... E01B 3/34
238/283
2018/0051422 A1* 2/2018 Nguyen ..... E01B 9/306

* cited by examiner

RAIL CLIP

PRIORITY

Priority is claimed as a national stage application, under 35 U.S.C. § 371, to international patent application No. PCT/US2016/026183, filed Apr. 6, 2106, which claims priority to Australian patent application 2015901236, filed Apr. 7, 2015. The disclosures of the aforementioned priority applications are incorporated herein by reference in their entirety.

This invention relates to a rail clip that may be used for both rollover protection and rail clamping.

BACKGROUND TO THE INVENTION

Traditionally, only the round bar clip can be used with screw spike type concrete tie.

These spikes are usually used on the rail ties used for rail joints.

Round bar clips in torsion, are prone to breakage under constant vibration.

Furthermore, the high contact stress between the round bar clip rear arch and the supporting guide plate can cause premature localized plate wear.

For zero longitudinal restraint, the concrete tie assembly requires that the clip does not exert any clamping force on the rail but must provide rail roll over protection. For this function, a different type of round bar clip must be used.

U.S. Pat. No. 1,115,153 discloses a rail joint fastener that requires no bolts through the rail.

U.S. Pat. No. 1,021,954 discloses a flat bar fastener in combination with a spike mounted rail chair.

U.S. Pat. No. 3,658,245 discloses a fastener for a rail joint that uses a custom rail plate.

U.S. Pat. No. 4,513,912 discloses a round bar clip with a spike mounted rail plate.

U.S. Pat. No. 7,874,527 discloses a flat bar clip used in a slide chair assembly.

U.S. Pat. No. 8,052,068 discloses a guide plate and round bar clip assembly.

It is an object of this invention to provide a rail clip that may be used for both rollover protection and rail clamping.

BRIEF DESCRIPTION OF THE INVENTION

To this end the present invention provides a flat bar elastic rail clip in which the flat bar is turned back on itself so that one portion is longer than the other. The flat bar incorporates an opening in both portions to accommodate a rail spike that is held in the rail tie. This type of spike is usually used in combination with a concrete tie and a guide plate that seats on the rail seat of the tie.

The combination of a shaped flat bar clip which is capable of providing both rail clamping and rollover protection configurations in combination with a guide plate and spike.

This invention provides an alternative fastener to the round bar clip with screw spike type concrete ties. The shaped flat bar clip is capable of providing both rail clamping and rollover protection configurations. The flat bar clip has a much larger contact area with the supporting guide plate and less likely to wear out plate prematurely. It may also be used for both rollover protection and rail clamping. Normally, this clip provides a nominal clamping force when used with an insulated joint bar assembly.

The same clip can be flipped over to provide only roll over protection in the zero longitudinal restraint configuration.

The clip shorter prong to longer prong ratio is approximately 83%, the two prongs are parallel to each other in the compressed state.

The clip of this invention is also easy to manufacture, resulting in substantial cost saving.

This invention also provides a guide plate to support the clip, which has clip holding recess, an anti-rotation feature, and screw over-drive protection feature.

DETAILED DESCRIPTION OF THE INVENTION

A preferred embodiment of the invention will now be described with reference to the drawings in which.

Figure 1:
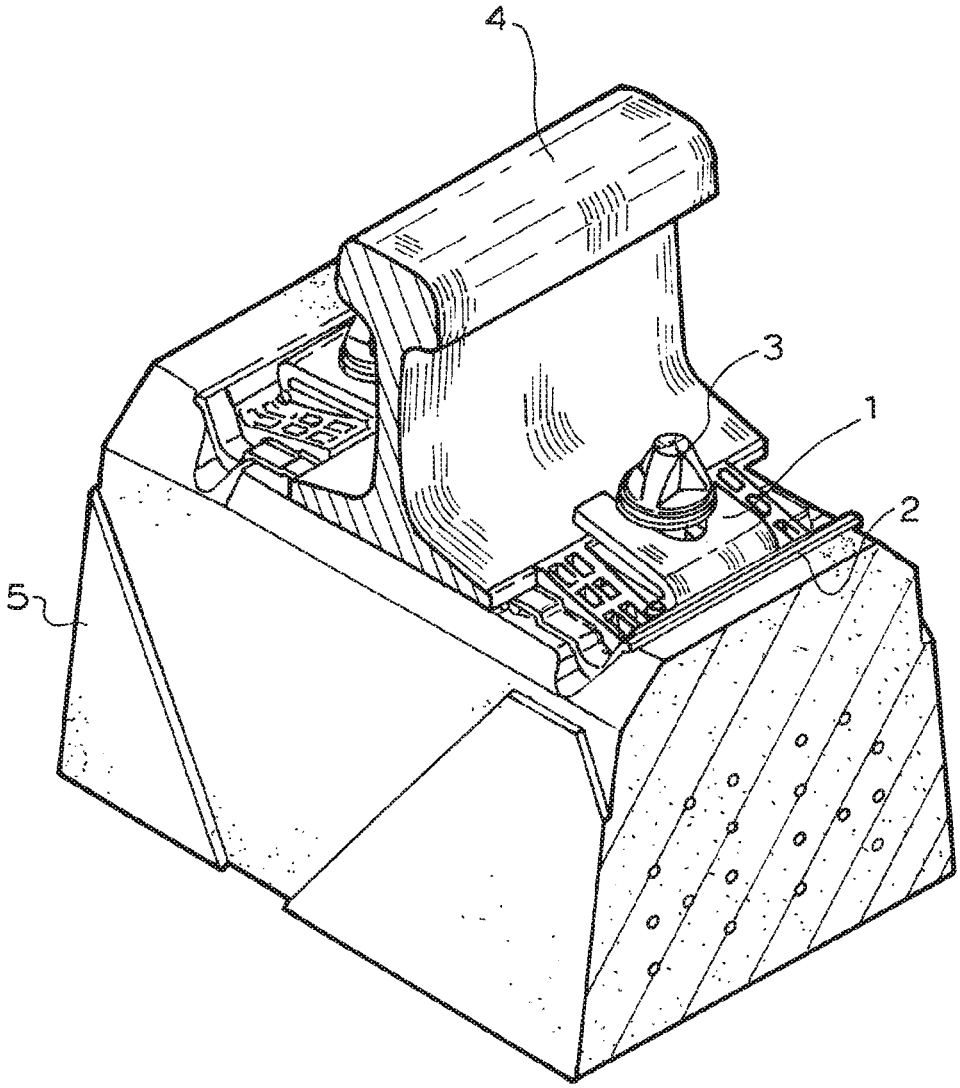
FIG. 1 depicts the complete fastening system on a concrete tie rail seat.

FIG. 1 shows the complete fastening system assembled in a rail seat section of the concrete tie 5. The rail 4 is supported in the bottom by the resilient rail pad 18, supported on the sides by the guide plate 2. The rail base is guarded by the flat bar clip 1 which is held down by the screw spike 3. The clip rear arch 12 is supported by guide plate 2 which rests against the concrete tie 5. FIG. 1 illustrates the clip in the zero longitudinal restraint configuration, required on the rail bridges. The fastening assembly in this mode only provides roll over protection and no clamping force.

Figure 2:
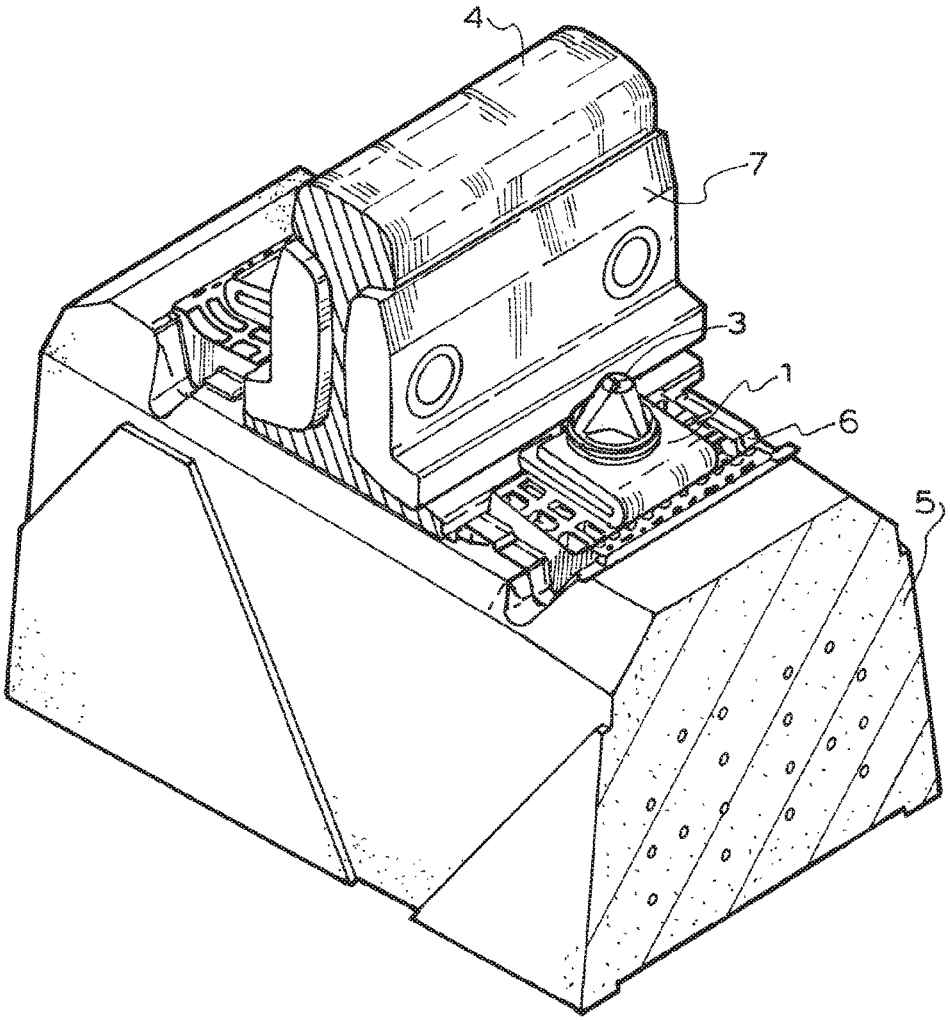
FIG. 2 depicts an insulated rail joint assembly.

FIG. 2 shows the insulated rail joint assembly. The joint bar 7 is used at the rail joint location. The clip 1 is flipped so the longer prong 8 clamps on the rail base. The clip 1 is also held down by the screw spike 3 and supported by the guide plate 6. In this mode the clip applies a clamping force on the rail base.

Figure 3:
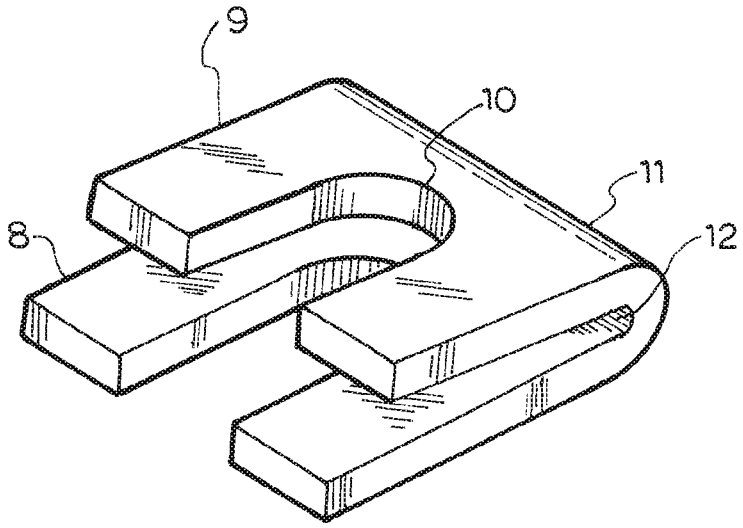
FIG. 3 depicts the rail clip of this invention.

FIG. 3 shows the clip 1 which has short prong 9, long prong 8, a semicircular slot 10.

The clip 1 has a rear resting surface 11, and bending arch 12.

Figure 4:
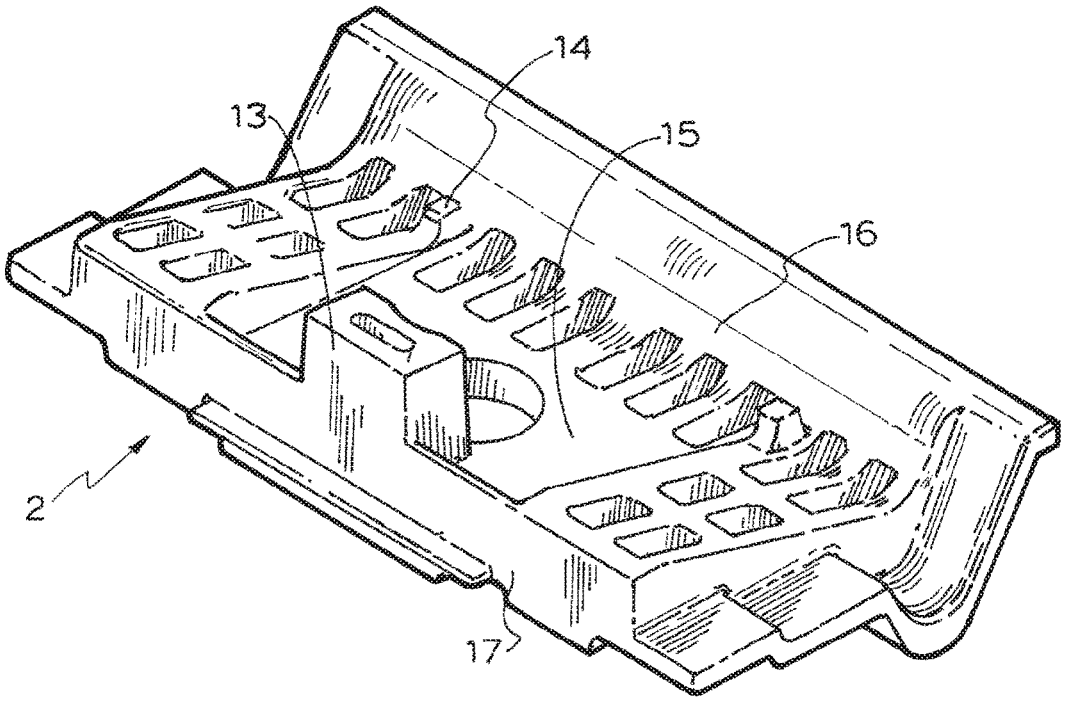
FIG. 4 depicts the guide plate of this invention.

FIG. 4 shows the guide plate 2 or 6, which has screw spike overdrive protection stand 13, clip anti rotation shoulder 14. The guide plate also has a clip prong support recess 15, and clip rear arch support wall 16. The guide plates may have different recesses 15 depending on whether the clip 1 is in rollover protection mode as shown in FIG. 1 or in clamping mode as shown in FIG. 2

Figure 5:
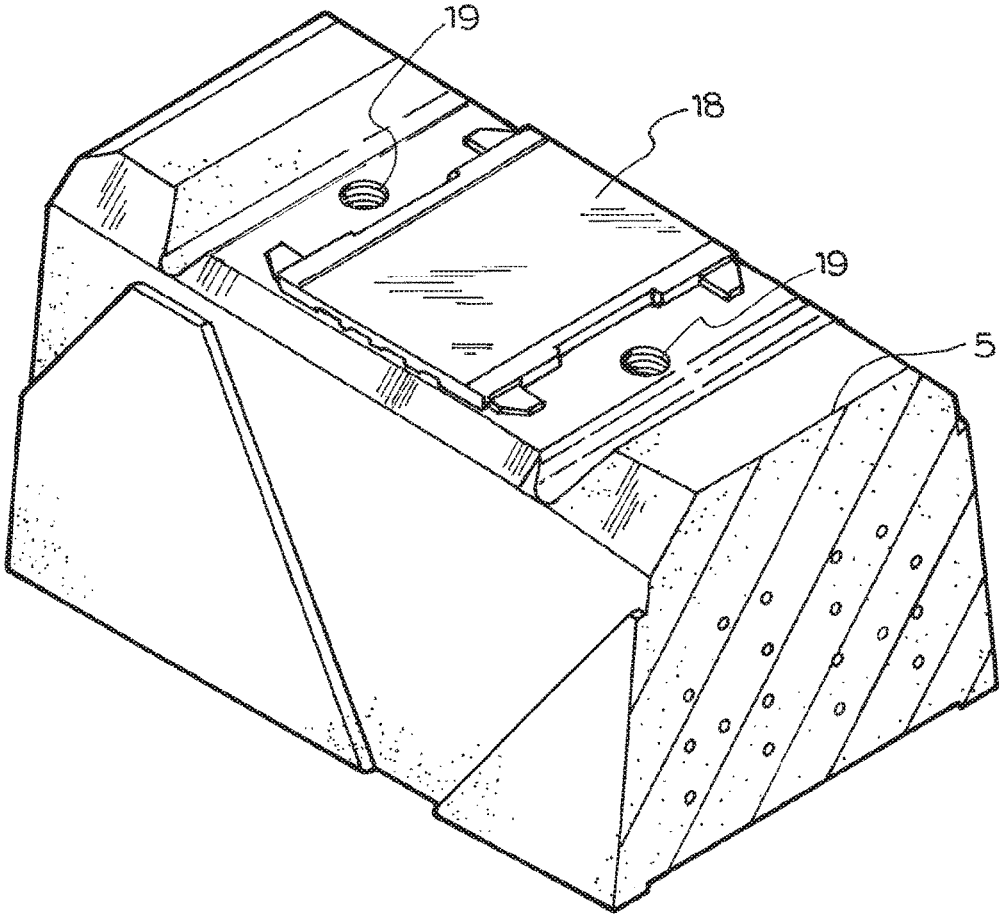
FIG. 5 illustrates the concrete tie and rail pad as used in the FIG. 1 rail seat.

FIG. 5 shows the concrete tie and rail pad assembly. The concrete tie 5 has two plastic inserts 19 which are cast in the concrete, and rail pad 18 which supports the rail. The plastic inserts include holes for the spikes 3. The rail tie includes grooves or slots for the curved rear edges of the guide plates as shown in FIGS. 1 and 2

From the above those skilled in the art will realise that this invention provides a dual use clip that replaces two separate clips. This has advantages in terms of cost and inventory management.

Those skilled in the art will also realise that this invention can be implemented in embodiments other than those described without departing from the core teachings of this invention.

The invention claimed is:

1. A rail fastening system, comprising:

a rail extending along a longitudinal direction, the rail including a base flange that extends along a transverse direction, the transverse direction being transverse to the longitudinal direction; and an elastic rail clip including a flat bar extending from a first end to a second end, the flat bar being turned back on itself to define a bending arch, the flat bar including a first portion and a second portion, a length of the first portion extending from the bending arch to the first end along the transverse direction, a length of the second portion extending from the bending arch to the second end along the transverse direction, the length of the second portion being greater than the length of the first portion, the second portion of the flat bar overlapping with the base flange of the rail along the transverse direction and bearing upon the base flange of the rail, the first portion of the flat bar being disposed entirely outside an overall width of the base flange along the transverse direction.

2. The rail fastening system of claim 1, wherein an internal surface of the first portion defines a first opening therethrough, an internal surface of the second portion defines a second opening therethrough, and the first opening overlaps with the second opening along the transverse direction.

3. The rail fastening system of claim 2, further comprising:

a rail tie disposed beneath the rail along a vertical direction, the vertical direction being transverse to both the longitudinal direction and the transverse direction;

a guide plate seated on a side of the rail along the transverse direction; and a rail spike passing through the guide plate, the first opening, and the second opening, the rail spike being held in the rail tie.

4. The rail fastening system of claim 1, wherein a ratio of the length of the first portion to the length of the second portion is approximately 0.83.

5. The rail fastening system of claim 1, further comprising:

a rail tie disposed beneath the rail along a vertical direction, the vertical direction being transverse to both the longitudinal direction and the transverse direction;

a guide plate seated on a side of the rail along the transverse direction; and a rail spike passing through the guide plate and the elastic rail clip, the rail spike being held in the rail tie.

6. The rail fastening system of claim 5, wherein the first portion is disposed between the second portion and the base flange along the vertical direction.

7. The rail fastening system of claim 5, wherein the second portion is disposed between the first portion and the base flange along the vertical direction.

8. The rail fastening system of claim 7, further comprising a joint bar disposed between the elastic rail clip and the rail along the transverse direction.

9. The rail fastening system of claim 1, wherein the first portion is disposed between the second portion and the base flange along a vertical direction, the vertical direction being transverse to both the longitudinal direction and the transverse direction.

10. The rail fastening system of claim 1, wherein the second portion is disposed between the first portion and the base flange along a vertical direction, the vertical direction being transverse to both the longitudinal direction and the transverse direction.

11. The rail fastening system of claim 10, further comprising a joint bar disposed between the elastic rail clip and the rail along the transverse direction.

* * * * *